US008926337B2

(12) United States Patent
Siahaan et al.

(10) Patent No.: US 8,926,337 B2
(45) Date of Patent: Jan. 6, 2015

(54) METHOD FOR IMPROVING CONNECTOR ENCLOSURE ADHESION

(71) Applicant: Apple Inc., Cupertino, CA (US)

(72) Inventors: Edward Siahaan, San Francisco, CA (US); Michael Webb, Scotts Valley, CA (US)

(73) Assignee: Apple Inc., Cupertino, CA (US)

( * ) Notice: Subject to any disclaimer, the term of this patent is extended or adjusted under 35 U.S.C. 154(b) by 75 days.

(21) Appl. No.: 13/722,887

(22) Filed: Dec. 20, 2012

(65) Prior Publication Data

US 2014/0057496 A1 Feb. 27, 2014

Related U.S. Application Data

(60) Provisional application No. 61/693,163, filed on Aug. 24, 2012.

(51) Int. Cl.

| | |
|---|---|
| ***H01R 11/30*** | (2006.01) |
| ***H01R 13/46*** | (2006.01) |
| ***H01R 43/00*** | (2006.01) |
| ***H01R 13/504*** | (2006.01) |
| *H01R 24/60* | (2011.01) |

(52) U.S. Cl.

CPC ..... *H01R 13/46* (2013.01); *H01R 24/60* (2013.01); *H01R 43/00* (2013.01); *H01R 13/504* (2013.01)

USPC ..... 439/40

(58) Field of Classification Search

USPC ..... 439/39, 40, 502, 449, 660; 174/76, 174/74 R, 84 R

See application file for complete search history.

(56) References Cited

U.S. PATENT DOCUMENTS

| | | | | |
|---|---|---|---|---|
| 5,231,248 | A * | 7/1993 | Shah | 174/76 |
| 5,373,407 | A * | 12/1994 | Stupak et al. | 360/99.08 |
| 5,618,880 | A * | 4/1997 | Okazaki et al. | 524/731 |
| 2005/0003709 | A1* | 1/2005 | Nagamine et al. | 439/587 |
| 2005/0042922 | A1* | 2/2005 | Haller et al. | 439/607 |
| 2006/0144014 | A1* | 7/2006 | Yoon et al. | 52/784.1 |
| 2011/0092081 | A1* | 4/2011 | Gao et al. | 439/40 |
| 2012/0208405 | A1* | 8/2012 | Wang et al. | 439/676 |
| 2012/0231653 | A1* | 9/2012 | Ardisana et al. | 439/449 |
| 2013/0263910 | A1* | 10/2013 | Shinohara | 136/244 |
| 2014/0106586 | A1* | 4/2014 | Boeck et al. | 439/188 |

* cited by examiner

*Primary Examiner* — Alexander Gilman

(74) *Attorney, Agent, or Firm* — Kilpatrick Townsend & Stockton LLP

(57) ABSTRACT

An improved method is employed to attach an enclosure to a connector body having relatively small geometry. One or more bonding channels are disposed in the outside surface of the connector body. During assembly of an enclosure over the connector body, a bonding material is distributed within the bonding channels and subsequently cured. The bonding channels and the bonding material are designed to employ capillary wicking to aid in the distribution of the bonding material within the bonding channels.

24 Claims, 10 Drawing Sheets

METHOD FOR IMPROVING CONNECTOR ENCLOSURE ADHESION

This application claims the benefit under 35 USC §119(e) to U.S. Provisional Patent Application No. 61/693,163, filed Aug. 24, 2012.

BACKGROUND OF THE INVENTION

The present invention relates generally to electrical connectors and in particular to connectors having enclosures.

A wide variety of electronic devices are available for consumers today. Many of these devices have connectors that that facilitate communication with and/or charging of the corresponding device. These connectors often interface with other connectors through cables that are used to connect devices to one another. Sometimes, connectors are used without a cable to directly connect the device to another device, such as a charging station or a sound system.

As smart-phones, media players and other electronic devices become more compact, their corresponding connectors play a greater role in the ultimate market success of the device. For example, in many nano-scale MP3 players and compact flash storage devices, the connectors actually dominate the physical geometry, the aesthetics and sometimes the cost of the electronic device. Thus, there is a continued desire to reduce the size and cost of the connectors.

As the size of the connectors are continually reduced, the associated component tolerances and clearances are commensurately reduced. For example, many connectors have an interior body that is covered with an enclosure. As the size of the connector has been reduced, the clearance between the enclosure and the body has also been significantly reduced. This significant reduction in clearance may present challenges in the assembly process.

As one example, a bonding material may be employed to affix the enclosure to the connector body. However, with reduced clearance between the enclosure and the body there may be insufficient clearance between these components to effectively distribute the bonding material. This may result in poor adhesion of the enclosure to the connector body, thus alternative designs are desirable.

BRIEF SUMMARY OF THE INVENTION

The present invention relates to attaching enclosures to connector bodies having relatively small geometry. By way of example, the design may be used on data and/or power connectors, such as USB connectors, Firewire connectors, Thunderbolt connectors and the like. The design enables more uniform distribution of bonding material between a connector body and an outer enclosure, resulting in greater bond strength and a more reliable connector. This design is particularly useful when the geometry and clearances within the connector are so small that it is difficult to adequately bond the enclosure to the connector body.

Some embodiments may comprise an insert molding process to form at least a portion of the body of the connector. This process may encapsulate some of the connector components while simultaneously forming bonding channels in the outside surface of the connector body. The bonding channels are essentially recesses in the body which may have an entry and a termination. In some embodiments the channels may have a depth that is greater at the entry than at the termination while some embodiments may have a substantially uniform depth.

In some embodiments the bonding channels may be substantially linear while in other embodiments they may be substantially non-linear. In other embodiments there may be more than one bonding channel. Further, the plurality of bonding channels may be distributed symmetrically or non-symmetrically on the outside surface of the connector body.

In some embodiments, a bonding material may be deposited on the inside surface of an enclosure, before it is slid over the connector body. The bonding material may be substantially aligned with the entry of the bonding channels. The process of sliding the enclosure over the body may create pressure on the bonding material causing it to smear, or distribute, across the outside surface of the connector body, including the bonding channels. In some embodiments, the bonding channels may create a low resistance "preferred path" for distribution of the bonding material. In other embodiments the bonding material and or the geometry and the surface finish of the bonding channels may be designed to employ capillary wicking to improve the distribution of the bonding material within the bonding channels.

In some embodiments the bonding material may be a cyanoacrylate that cures in the presence of moisture. In further embodiments the bonding material may be an epoxy or urethane that is heat cured. Other bonding materials are well known in the art and may be employed without departing from the invention.

To better understand the nature and advantages of the present invention, reference should be made to the following description and the accompanying figures. It is to be understood, however, that each of the figures is provided for the purpose of illustration only and is not intended as a definition of the limits of the scope of the present invention.

DETAILED DESCRIPTION OF THE INVENTION

Figure 1:
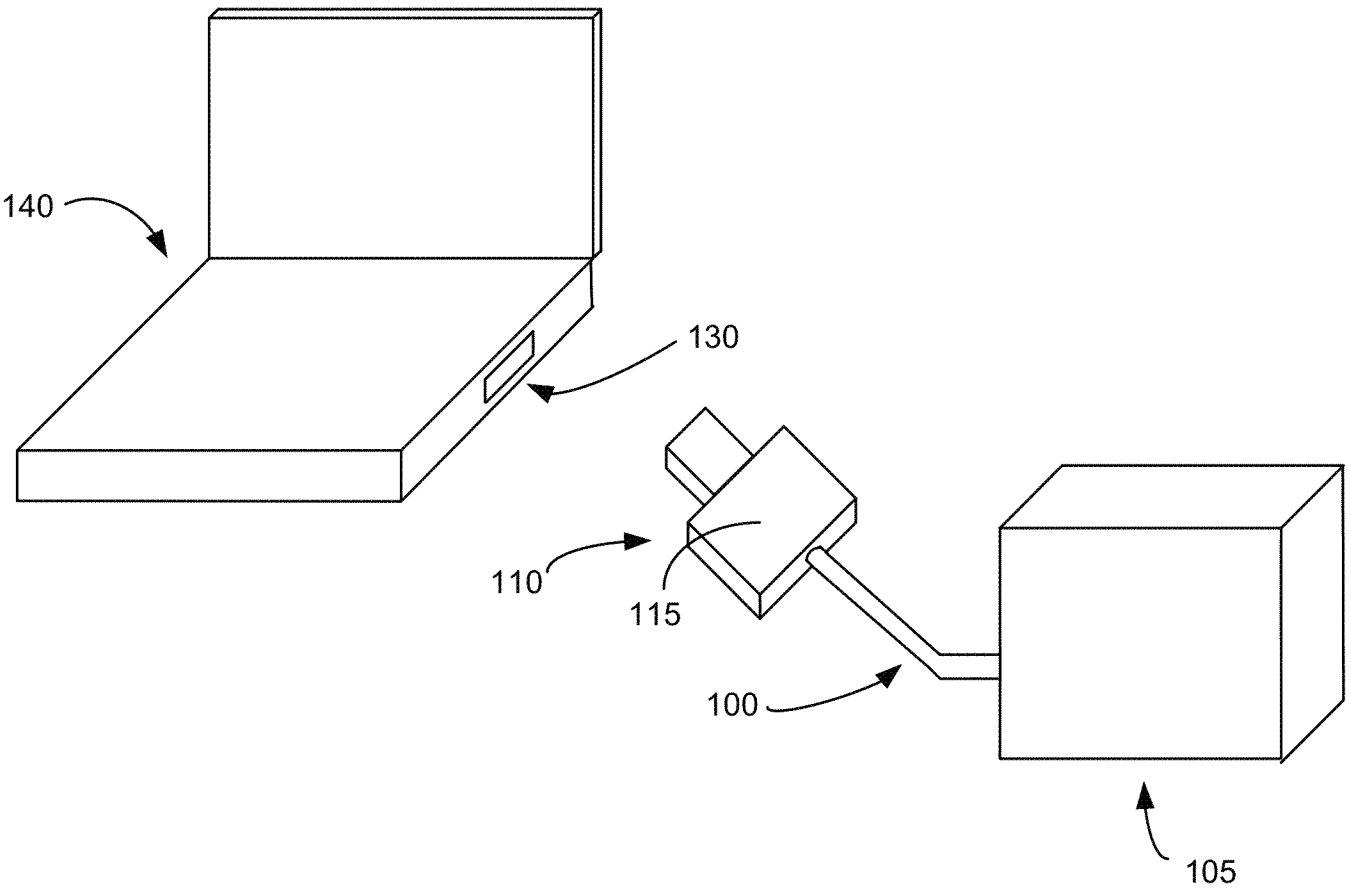
FIG. 1 is a diagram that illustrates an example two devices that can be interconnected with a cable, a connector plug and a connector receptacle.

Many electronic devices such as smart-phones, media players, and tablet computers have connectors that facilitate battery charging and/or communication with other devices. The connectors include a plurality of electrical contacts through which electrical connections are made to another compatible connector to transfer power and/or data signals through the connectors. FIG. 1 illustrates an example of two such connectors including a plug connector 110 and a receptacle connector 130. Each of these connectors 110, 130 may comply with a well-known standard such as Universal Serial Bus (USB) 2.0, Firewire, Thunderbolt, or the like or may be proprietary connectors, such as the 30-pin connector used on many Apple products among other types of proprietary connectors.

As further shown in FIG. 1, plug connector 110 is coupled to a cable 100, which in turn is coupled to a peripheral device 105 that can be any of many different electronic devices or accessories that operate with such devices. Receptacle connector 130 is incorporated into a computing device 140. When the plug connector 110 is mated with the receptacle 130, contacts within each connector (not shown in FIG. 1) are in physical and electrical contact with each other to allow electrical signals to be transferred between computing device 140 and peripheral device 105.

Typically, the plug connector is equipped with an enclosure 115 that covers the internal body of the connector, however the receptacle connector may also comprise such an enclosure. Thus, embodiments of the invention may be used in any or all of connectors 110 and 130. To further illustrate embodiments of the invention, various examples of connectors that include enclosures that may be made in accordance with the present invention are discussed below, however these embodiments should in no way limit the applicability of the invention to other connectors.

Figure 2:
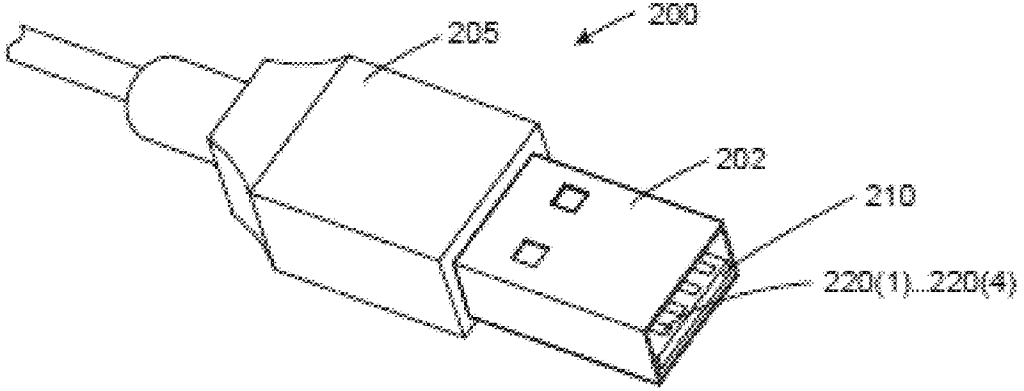
FIG. 2 is a diagram that illustrates an example of a connector plug with internal contacts.

As a first example, reference is made to FIG. 2, which depicts a simplified view of a USB plug connector that can be used as connector 110 shown in FIG. 1. Connector 200 has a metallic shield 202 that forms a cavity in which a plurality of contacts 220(1) . . . 220(4) are disposed on a contact retainer 210. The connector plug also has an enclosure 205 that covers the connector body (not shown). The enclosure may be made of plastic or another nonconductive material. Embodiments of the invention can be used in creation of the connector body, and for attaching the enclosure to the body.

While the present invention can be useful to adhere an enclosure to a body of any connector, some embodiments of the invention are particularly useful for adhering an enclosure to a body where the clearance between the body and the enclosure is particularly tight, such as 0.02 mm or less or even 0.01 mm or less, as described in more detail below. In instances where the clearance between the inside surface of the enclosure and the outside surface of the connector body is particularly tight, without the benefit of the present invention, it may be difficult to distribute bonding material between the enclosure and the connector body. Embodiments of the invention enable bonding material to be distributed in such instances where the clearance between the inside surface of the enclosure and the outside surface of the connector body is particularly tight, as described more fully below.

Figure 3:
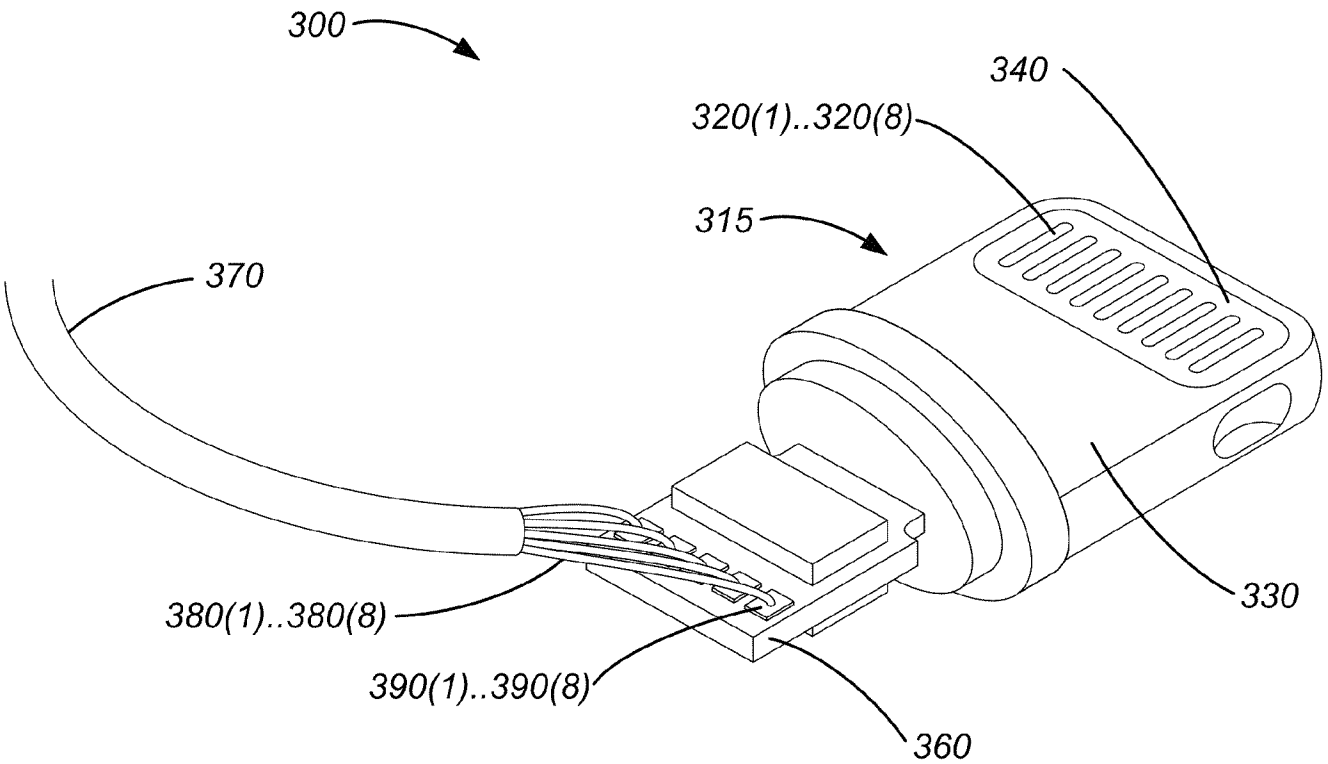
FIG. 3 is a diagram that illustrates an example of a connector tab with external contacts, an interface board and a cable.
Figure 4A:
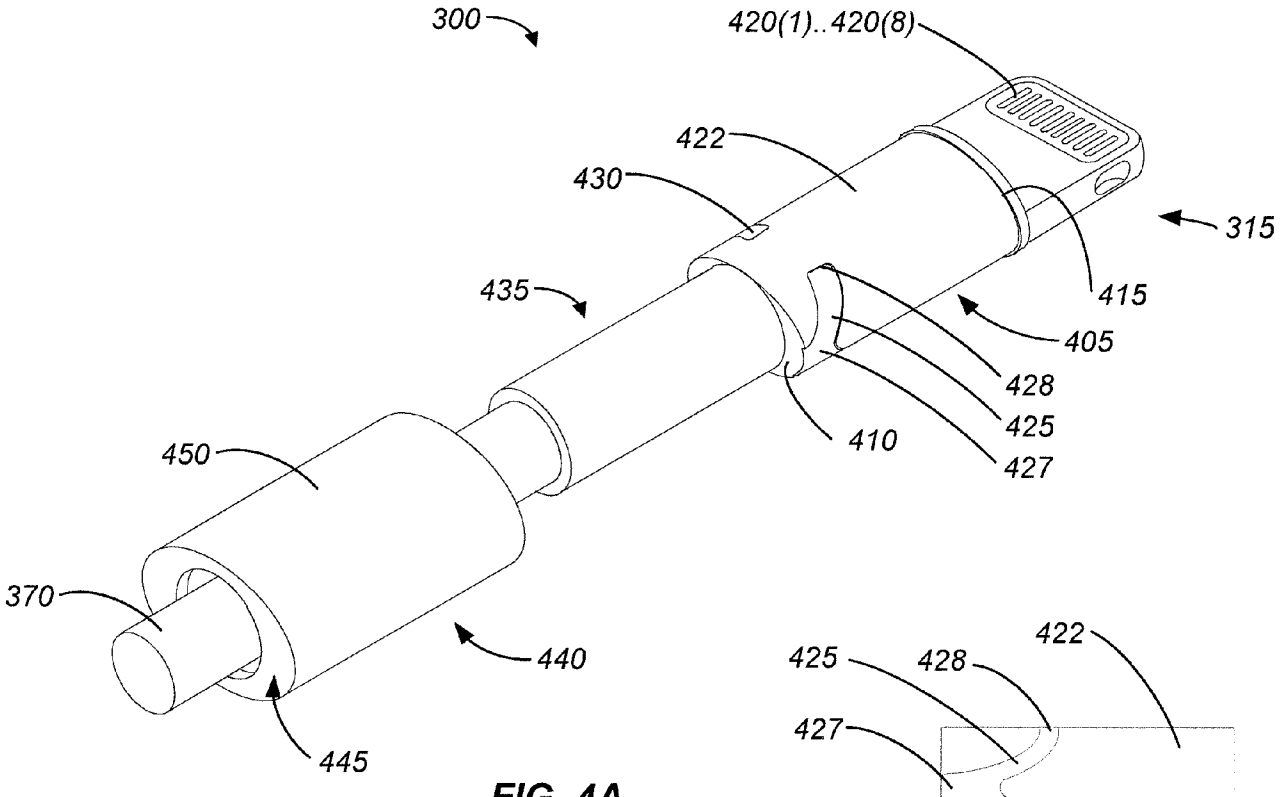
FIG. 4A is a diagram that illustrates an example of a connector plug after insert molding and an enclosure in a preassembled position.
Figure 4B:
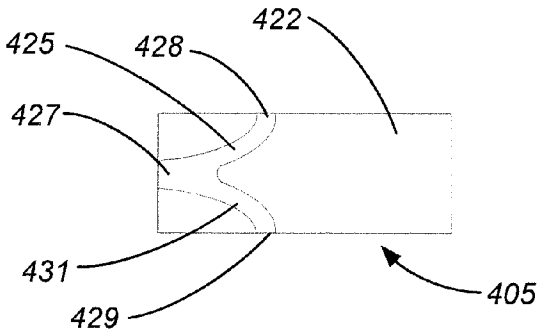
FIG. 4B is a diagram that illustrates a side view of the connector body illustrated in FIG. 4A.
Figure 4C:
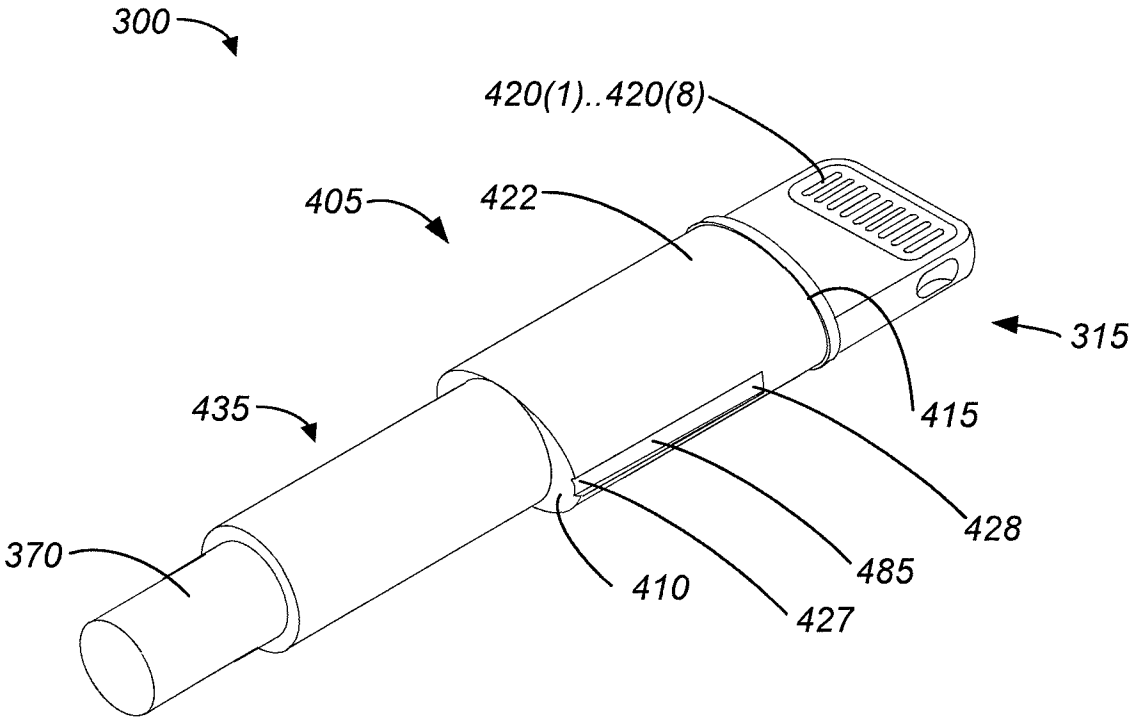
FIG. 4C is a diagram that illustrates an example of a connector plug after insert molding and an enclosure in a preassembled position.
Figure 4D:
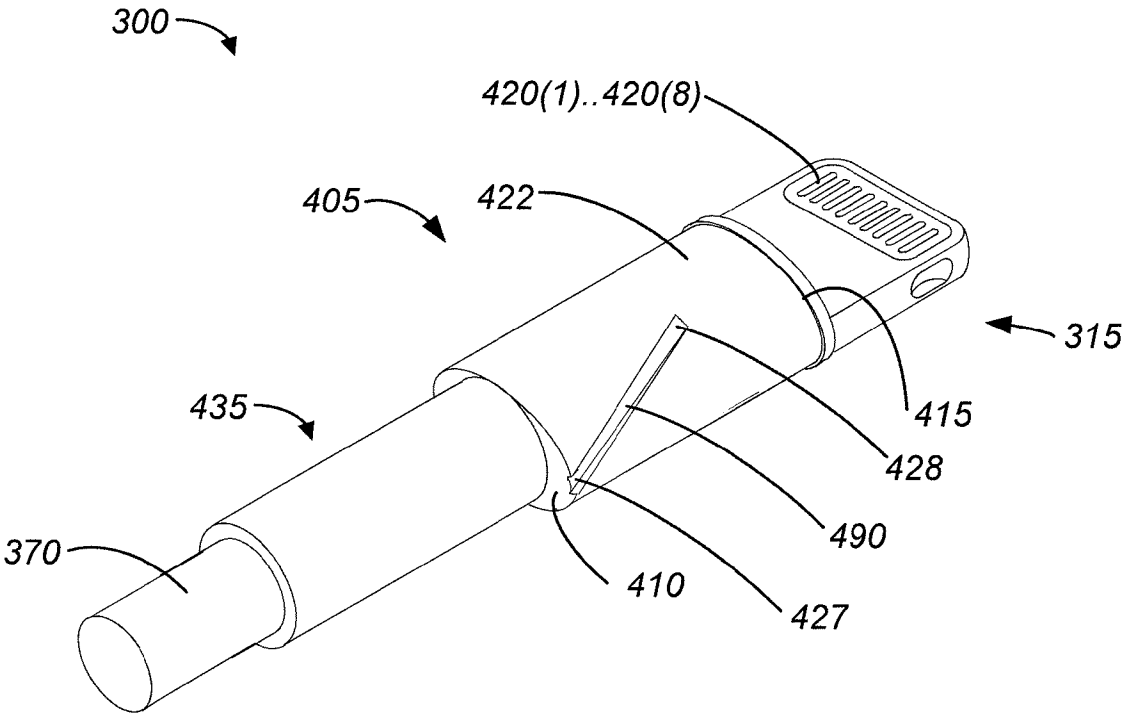
FIG. 4D is a diagram that illustrates an example of a connector plug after insert molding.
Figure 4E:
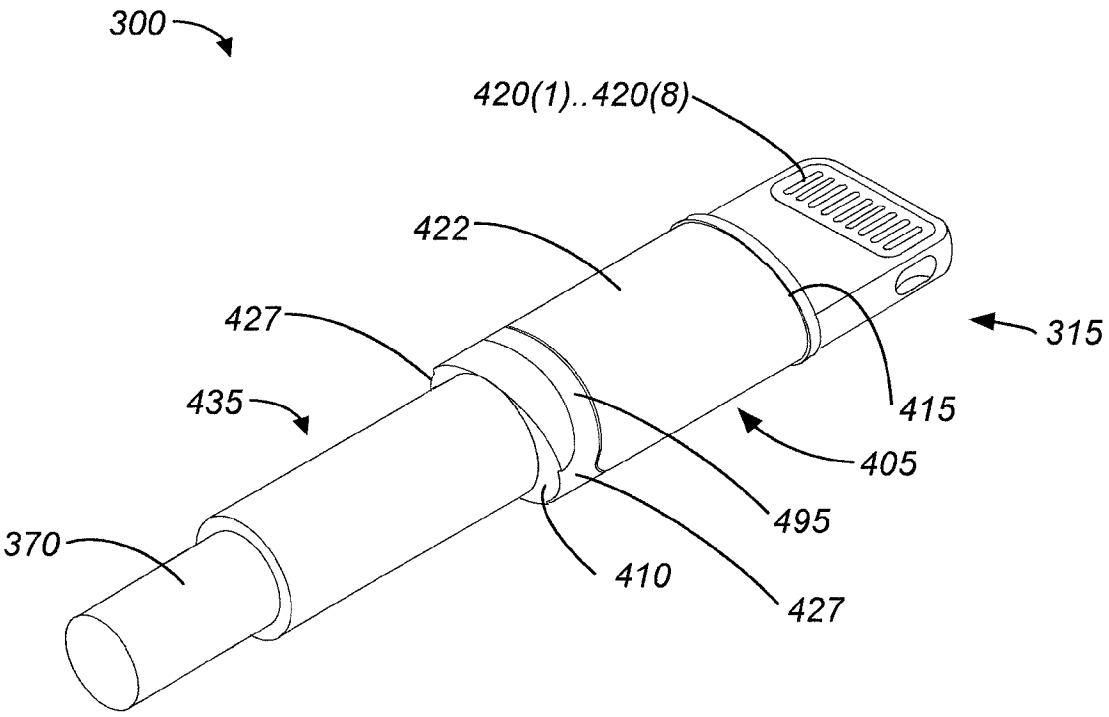
FIG. 4E is a diagram that illustrates an example of a connector plug after insert molding.

As another example of an embodiment of the invention, reference is made to FIGS. 3-4E, several of which show perspective views of a plug connector 300 at successive stages of assembly. As shown in FIG. 3, plug connector 300 includes a connector tab 315 that is sized to be inserted into a cavity in a corresponding receptacle connector (not shown). Tab 315 includes a metal ground ring 330 that surrounds a plurality of external contacts 320(1) . . . 320(8) formed at a first surface of the connector within a contact region 340 that can be filled with an injection molding compound to surround the contacts. Contacts 320(1) . . . 320(8) are considered external contacts because they are disposed on the outside of the connector and are readily visible when one views the connector. In contrast, the internal contacts 220(1) . . . 220(4) depicted in FIG. 2 are disposed within a shell or other type of cavity such as employed in a USB connector.

FIG. 3 also depicts an interface board 360 which may be a printed circuit board, a ceramic substrate, or other similar material known to those of skill in the art. The interface board electrically connects the contacts 320(1) . . . 320(8) to the cable 370. The contacts may be soldered to the interface board to improve the reliability of the assembly. The cable 370 may be comprised of multiple conductors 380(1) . . . 380(8) each of which may be soldered or bonded to corresponding bonding pads 390(1) . . . 390(8) disposed on the interface board. In this embodiment the interface board is sandwiched between two pluralities of contacts and the base of each contact is electrically connected to the interface board.

Referring to FIG. 4A, the connector 300 is shown in a subsequent stage of assembly. A first insert molding operation has been performed, encapsulating the interface board in plastic material, forming the body 405 of the connector. A second insert molding process has created a strain relief sleeve 435 attached to the rear face 410 of the connector body 405 and extending over the cable 370 for a short distance. In some embodiments the connector body may be made partially from insert molded plastic and partially from other materials. The first and second insert molding materials may be any type of plastic or other non-conductive material. In one embodiment, both materials are thermoplastic elastomers wherein the second insert molding material is of a lower durometer than the first insert molding material.

Body 405 has a rear face 410 and a front face 415 from which the connector tab 315 extends longitudinally away from the connector body. Between the front face and the rear face an outside surface 422 of the connector body is formed. Further, the front face and rear face may be called opposing major surfaces and the outside surface 422 may be divided into third and fourth opposing minor surfaces. The outside surface 422 may comprise plastic or a combination of plastic and other materials. As previously mentioned, some embodiments of the invention pertain to relatively small connectors. In one particular embodiment, the perimeter of the body 405 is less than 30 mm. In one embodiment the perimeter is oriented in the same plane as face 410.

Some embodiments of the invention form bonding channels 425 and 430 in the connector body 405. In further embodiments the bonding channels are formed during the insert molding process but in other embodiments they can be formed after the molding process by, for example, etching, cutting, milling, forming, scraping or otherwise displacing material from the outer surface. Bonding channels provide areas of increased clearance for effective distribution of bonding material which may be placed between the enclosure 440 and the outside surface 422 of the connector body 405. Without the benefit of the bonding channels, when clearance between the enclosure 440 and the outside surface 422 of the connector body 405 is particularly tight, bonding material that may normally be used to bond the two parts together may not be able to be substantially distributed along the outside surface 422 of the connector body 405. Instead, the bonding material may be simply pushed to the rear face 445 of the enclosure 440 which may result in poor distribution of the bonding material and poor adhesion of the enclosure to the connector body. The inclusion of the bonding channels 425, 430 according to embodiments of the invention solves this problem.

Each bonding channel may have an entry 427 at the rear face 410 of the connector body 405 and end at a termination 428. Further, from FIG. 4A it can be seen that the bonding channels 425, 430 may have an entry 427 on either side of the connector body and wrap around the connector body towards the top surface of the connector body. As depicted in FIG. 4B, some embodiments may also have bonding channels 425, 431 that join at a common entry 427 on the side of the connector body and include first and second legs wherein the first leg extends from the common entry to a first termination 428 along the top surface of the connector body and the second leg extends from the common entry to a second termination 429 along the bottom surface of the connector body. Some embodiments may have four distinct bonding channels with two common entries and four distinct terminations.

As depicted in FIGS. 4C and 4D, some embodiments may have bonding channels 485, 490 that are substantially linear, while in other embodiments, depicted in FIGS. 4A and 4E, the bonding channels 425, 495 may be substantially non-linear. As depicted in FIG. 4C, some embodiments may have bonding channels 485 that are longitudinally aligned with the connector body 405, while some embodiments, as depicted in FIG. 4D, may have bonding channels 490 that are angular with respect to the longitudinal axis of the connector body. As depicted in FIG. 4E, some embodiments may have bonding channels 495 that have no termination and are substantially U-shaped, beginning and ending at entry locations 427. In some embodiments there may only be one bonding channel, while in others there may be a plurality of bonding channels. Further, some embodiments may have a non-symmetric arrangement of the bonding channels while other embodiments may have a substantially symmetric arrangement of the bonding channels.

Figure 4F:
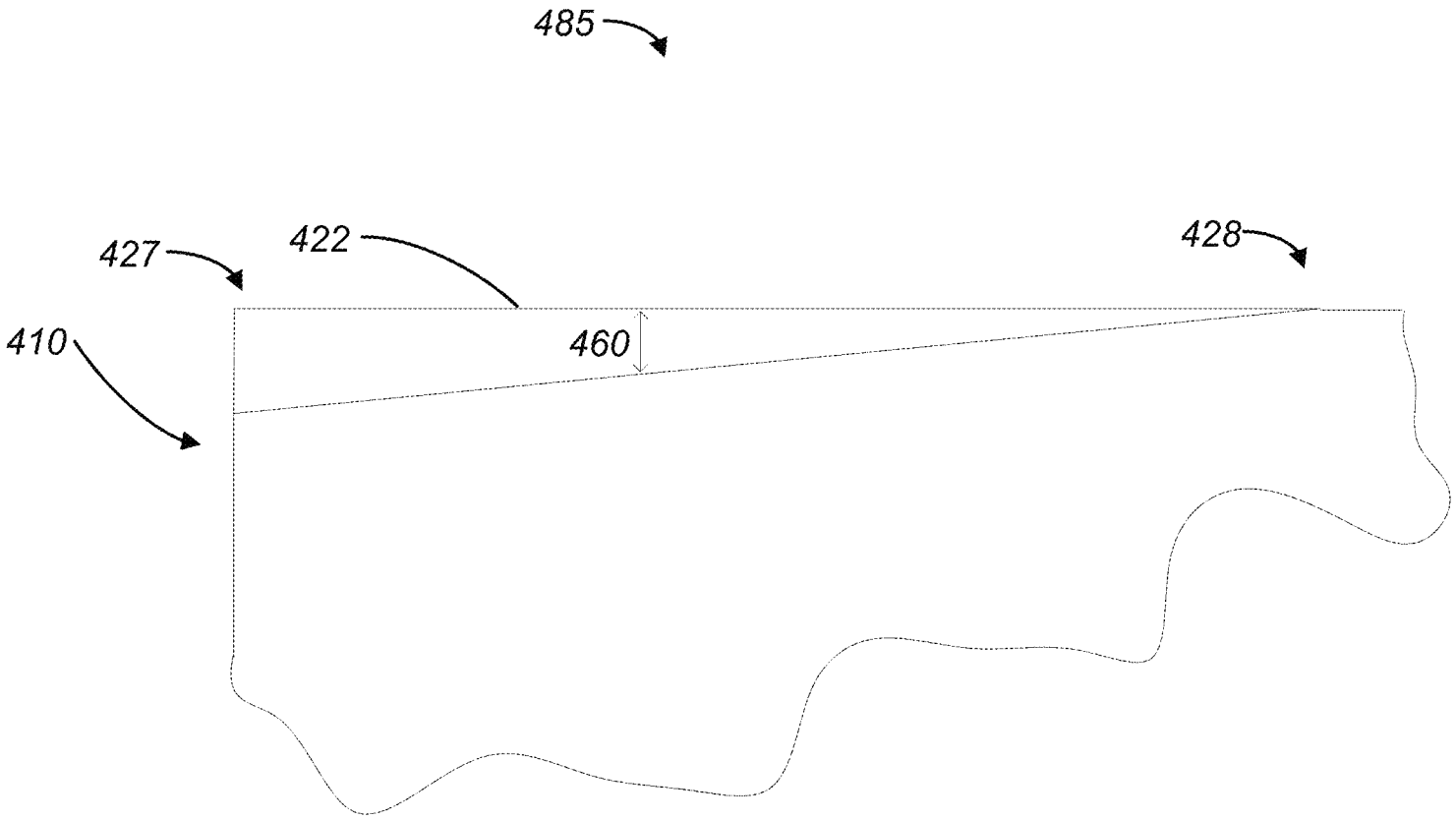
FIG. 4F is a diagram that illustrates a longitudinal cross section of a bonding channel in accordance with an embodiment of the invention.

A longitudinal cross-section of an exemplary bonding channel 485 is shown in FIG. 4F. This figure shows that the depth 460 of the bonding channel may be deeper at the entry 427 on the rear face 410 of the connector body 405 than at the termination 428. In some embodiments the depth of the bonding channel at the entry may be approximately 0.05 mm while at the termination the depth may taper to 0.00 mm. In some embodiments the depth of the bonding channel at the entry may be less than 0.1 mm. However, in other embodiments the bonding channel may have a substantially uniform depth. In some embodiments the width of the channel may be substantially constant while in some embodiments the width of the channel may vary. In further embodiments the bottom surface of the bonding channel may have a different surface roughness than the outside surface of the connector body.

Referring back to FIG. 4, an enclosure 440 is illustrated in a preassembled position. The enclosure is sized appropriately to slide over the connector body 405, substantially enclosing the connector body within the enclosure. The enclosure has a rear face 445 and an outside surface 450. The enclosure can be manufactured from any type of plastic or other non-conductive material. In some embodiments the clearance between an inside surface of enclosure 440 and outer surface 422 of body 405 is less than or equal to 0.02 mm.

Figure 5B:
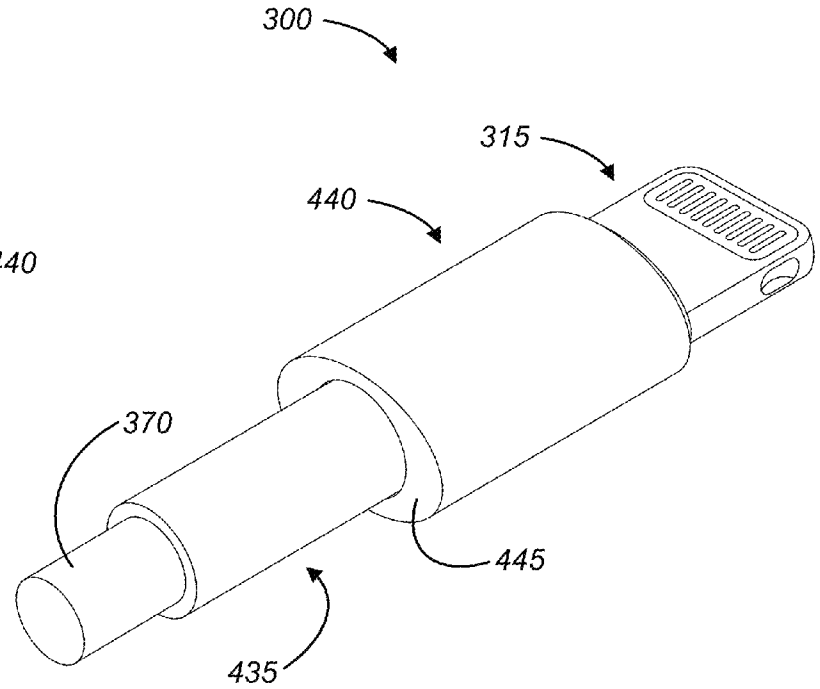
FIG. 5B is a diagram that illustrates a fully assembled connector in accordance with an embodiment of the invention.
Figure 5A:
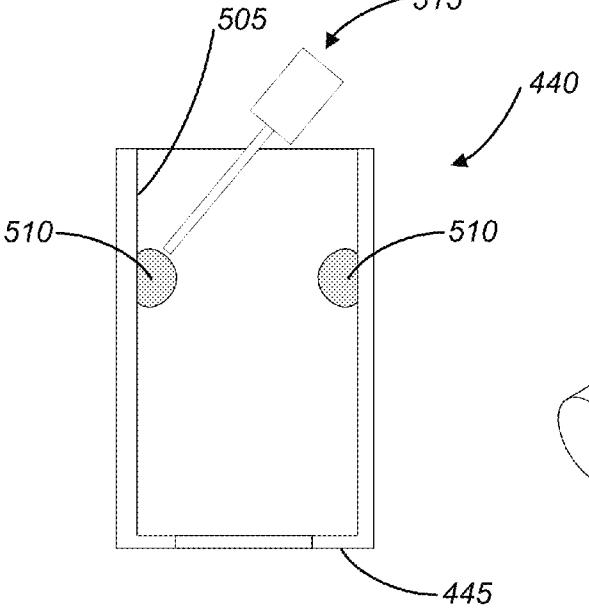
FIG. 5A is a diagram that illustrates a cross-sectional view of an enclosure with bonding material.

A cross-sectional view of the enclosure 440 is shown in FIG. 5A. FIG. 5A further depicts bonding material 510 deposited on two locations on an inside surface 505 of the enclosure 440. The bonding material may be deposited with a syringe and needle assembly 515 as shown, or it can be deposited with myriad other techniques, known to those of skill in the art, without departing from the invention. The final assembly step is shown in FIG. 5B and comprises sliding the enclosure 440 over the connector body 405 (see FIG. 4A) until the inside surface 505 of the rear face 445 of the enclosure meets the rear face 410 of the connector body.

In some embodiments, during the sliding process, the bonding material 510 may be substantially aligned with the entry 427 of the bonding channels 425, 430 (see FIGS. 4A and 5A). The process of sliding the enclosure over the body may create pressure on the bonding material causing it to smear, or "distribute" across the outside surface 422 of the connector body 405, including the bonding channels 425, 430. Additionally, the bonding channels 425, 430 may create an increased clearance between the inside surface 505 of the enclosure 440 and the outside surface 422 of the connector body 405 allowing improved distribution of the bonding material 510 with the basic means of pressure and smearing created by the assembly process. In these embodiments, the bonding channels may create a "preferential path" for distribution of the bonding material where a significant portion of the distribution of the bonding material occurs within the channels and less distribution occurs on the outside surface of the connector body. Increased distribution of the bonding material may result in a larger area of adhesion which in turn may result in an increased bond force between the connector body and the enclosure.

In further embodiments the bonding material 510 and or the geometry and the surface finish of the bonding channels 425, 430 may be designed to employ capillary wicking to improve the distribution of the bonding material within the bonding channels. Capillary wicking occurs when the adhesion forces of the bonding material to the walls of the bonding channels is greater than the cohesive forces between the molecules of the bonding material. The surface tension of the bonding material holds the bonding material intact while the adhesive forces pull the bonding material from the entry 427 of the bonding channel towards the termination 428. In these embodiments, as soon as the enclosure 440 is assembled over the connector body 405, the bonding material may wick from the channel entry towards the termination, resulting in substantially distributed bonding material.

In some embodiments the surface roughness of the bonding channel surfaces may be increased as compared to the surface roughness of the connector body to improve capillary wicking. In some embodiments the surface roughness of the bonding channels may be increased to aid in achieving increased mechanical bond strength. In some embodiments the surface roughness and/or surface free energy of the body or the enclosure may be increased by exposure to a media blasting process or a plasma treatment.

Still referring to FIGS. 4A and 5A, the final assembly step may be to cure the bonding material 510, adhering the inside surface 505 of the enclosure 440 to the outside surface 422 of the connector body 405. In some embodiments the bonding material may be a cyanoacrylate that cures in the presence of moisture. In other embodiments the bonding material may be an epoxy or urethane that is heat cured. Other bonding materials are well known in the art and may be employed without departing from the invention.

In further embodiments, the uncured bonding material may not have the necessary physical properties at room temperature for capillary wicking, but may develop the necessary physical properties during a curing process at elevated temperatures. Thus, when placed in a high temperature environment, the bonding material may change physical characteristics and wick substantially throughout the bonding channels 425, 430. After the wicking is complete the bonding material may further change physical characteristics and fully cure, bonding the enclosure 440 to the connector body 405.

Figure 6:
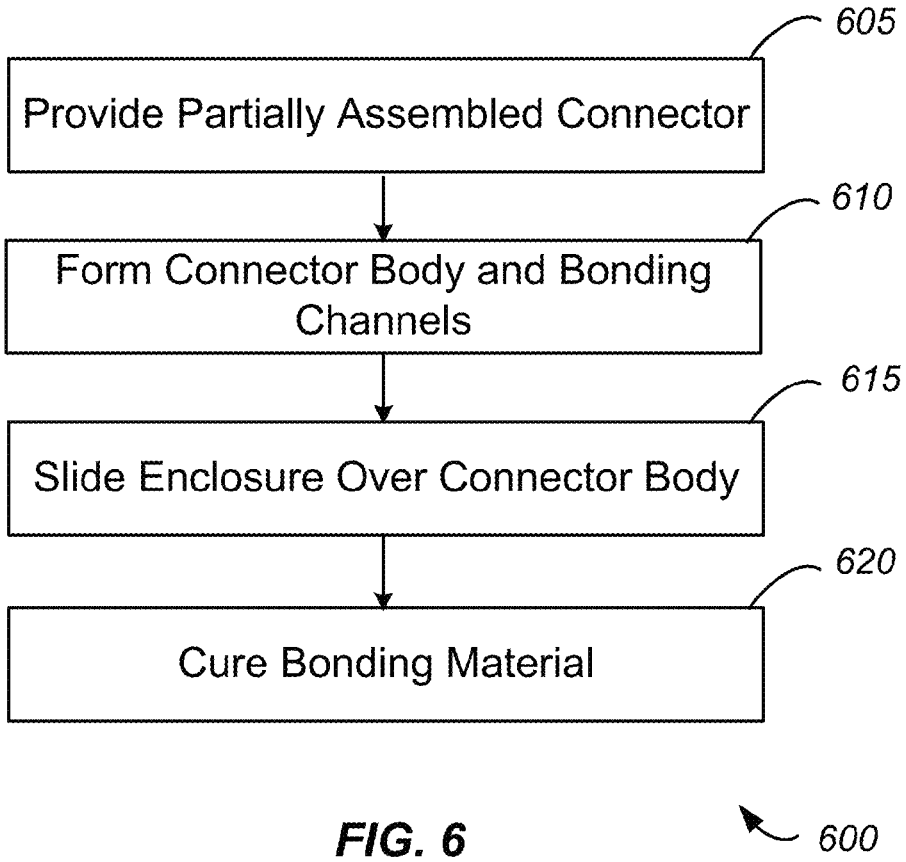
FIG. 6 is a process by which a connector in accordance with an embodiment of the invention can be manufactured.

FIG. 6 illustrates a simplified process 600 for manufacturing a connector in accordance with embodiments described herein. In step 605 a partially assembled connector is provided. In some embodiments this may comprise a connector tab subassembly with at least a cable and an interconnect board. In other embodiments this may simply be a connector contact array and a cable. In step 610 the connector body is formed. The connector body may be formed by placing the partially assembled connector from step 605 in an insert molding machine and injecting plastic material around the subassembly. In other embodiments a separate metal shell or one or more other components may be added during the formation of the connector body. Bonding channels are also formed in step 610. In some embodiments these may be formed during the insert molding process while in other embodiments they may be formed after the molding process by selectively displacing material from the surface of the connector body. In step 615 the enclosure is supplied and assembled by sliding it over the connector body until it substantially encloses the connector body. Before assembly, bonding material may be deposited on the inside surface of the enclosure. In some embodiments, the bonding material may be distributed in the bonding channels during the assembly process. In other embodiments the bonding material distribution may simply be due to the assembly process while in other embodiments it may be due to capillary forces wicking the bonding material substantially throughout the bonding channels. Finally, in step 620 the bonding material is cured and the connector is completed.

In the foregoing specification, embodiments of the invention have been described with reference to numerous specific details that may vary from implementation to implementation. The specification and drawings are, accordingly, to be regarded in an illustrative rather than a restrictive sense. The sole and exclusive indicator of the scope of the invention, and what is intended by the applicants to be the scope of the invention, is the literal and equivalent scope of the set of claims that issue from this application, in the specific form in which such claims issue, including any subsequent correction.

What is claimed is:

1. A connector comprising:

a body having first and second faces on opposite sides of the body and an outside surface that extends between the first and second faces;

a bonding channel extending along the outside surface of the body, the bonding channel having an entry at the first face;

a plug extending from the second face of the body to a distal end of the connector;

a plurality of contacts carried by the plug; and an enclosure that surrounds the outside surface of the body covering the bonding channel and is bonded to the body by bonding material disposed within the bonding channel.

2. The connector set forth in claim 1, wherein the bonding channel has a depth that varies along a length of the bonding channel from a first depth at the entry to a second depth that is smaller than the first depth.

3. The connector set forth in claim 1 further comprising a plurality of bonding channels extending along the outside surface, each bonding channel having a respective entry at the first face and a depth that varies along a length of the channel from the first depth at the respective entry to the second depth.

4. The connector set forth in claim 3, wherein the plurality of bonding channels are positioned symmetrically along the outside surface.

5. The connector set forth in claim 1, wherein the enclosure includes a first enclosure face aligned with the first face of the body to cover the entry to the bonding channel.

6. The connector set forth in claim 1, wherein the bonding material comprises a moisture-cured bonding material.

7. The connector set forth in claim 1 further comprising:

a plurality of bonding pads within the body, each of the plurality of bonding pads being electrically coupled to a corresponding contact in the plurality of contacts; and a cable having a plurality of conductors, each of the conductors bonded to one of the plurality of bonding pads at a location within the body.

8. The connector set forth in claim 1, wherein the outside surface of the body has a first roughness and a bottom surface of the bonding channel has a second roughness that is greater than the first roughness.

9. The connector set forth in claim 1, wherein the perimeter of the body is less than or equal to 30 mm.

10. The connector set forth in claim 1, wherein a first portion of the body comprises a metal enclosure and a second portion of the body is formed from a plastic compound injected to be integral with the metal enclosure

11. An electrical connector comprising:

a body having first and second faces on opposite sides of the body and an outside surface that extends between the first and second faces;

first and second bonding channels extending along the outside surface of the body, the first and second bonding channels having first and second entries, respectively, at the first face and a depth that varies along a length of the channel from a first depth at the entry to a second depth that is smaller than the first depth;

an enclosure that surrounds the outside surface of the body covering the first and second bonding channels and bonded to the body by bonding material disposed within the first and second bonding channels;

a plug extending from the second face of the body to a distal end of the connector;

a plurality of contacts carried by the plug;

a plurality of bonding pads within the body, each of the plurality of bonding pads being electrically coupled to a corresponding contact in the plurality of contacts; and a cable having a plurality of conductors, each of the conductors bonded to one of the plurality of bonding pads at a location within the body.

12. The connector set forth in claim 11 wherein:

the body has width, height and length dimensions;

the outside surface of the body has first and second opposing major surfaces extending in the width and length dimensions, and third and fourth opposing minor surfaces extending between the first and second major surfaces in the height and length dimensions;

the first entry for first bonding channel is at an intersection of the first face and the third minor surface and the second entry for the second bonding channel is at an intersection of the first face and the fourth minor surface;

the first bonding channel includes first and second legs that join at the first entry, the first leg extending from the first entry to a first termination along the first major surface, the second leg extending from the first entry to a second termination along the second major surface, each of the first and second legs having a depth that decreases from the first entry to the first and second terminations, respectively; and the second bonding channel includes third and fourth legs that join at the second entry, the third leg extending from the second entry to a third termination along the first major surface, the fourth leg extending from the second entry to a fourth termination along the second major surface, each of the third and fourth legs having a depth that decreases from the second entry to the third and fourth terminations, respectively.

13. A method of enclosing a connector, the method comprising:

forming a body having first and second faces on opposite sides of the body and an outside surface that extends between the first and second faces;

wherein a plug extends from the second face of the body to a distal end of the connector;

forming a bonding channel extending along the outside surface of the body, the bonding channel having an entry at the first face disposing a plurality of contacts within the plug; and disposing an enclosure on the body that surrounds the outside surface of the body covering the bonding channel and is bonded to the body by bonding material disposed within the bonding channel.

14. The method set forth in claim 13 wherein the bonding channel has a depth that varies along a length of the bonding channel from a first depth at the entry to a second depth that is smaller than the first depth.

15. The method set forth in claim 13 further comprising a plurality of bonding channels extending along the outside surface, each bonding channel having a respective entry at the first face and a depth that varies along a length of the channel from the first depth at the respective entry to the second depth.

16. The method set forth in claim 13, wherein the perimeter of the body is less than or equal to 30 mm.

17. A method of enclosing a connector, the method comprising:

molding a plastic body around at least a portion of a connector subassembly;

forming a bonding channel in an exterior surface of the plastic body;

forming an enclosure sized to receive the plastic body;

disposing adhesive on the plastic body or the enclosure;

sliding the enclosure over the plastic body; and distributing at least a portion of the adhesive within the bonding channel.

18. The method set forth in claim 17 wherein the bonding channel has a depth that varies along a length of the bonding channel from a first depth at an entry to a second depth that is smaller than the first depth.

19. The method set forth in claim 17 further comprising forming a plurality of bonding channels in the exterior surface of the plastic body.

20. The method set forth in claim 17, wherein the perimeter of the body is less than or equal to 30 mm.

21. A connector comprising:

a connector subassembly having an interface board, the interface board comprising a contact portion attached to a plurality of contacts and a conductor portion attached to a plurality of conductors;

a plastic body formed over at least the conductor portion of the interface board;

a bonding channel disposed in an outside surface of the plastic body;

an enclosure disposed around the plastic body; and adhesive disposed within the bonding channel.

22. The connector set forth in claim 21 wherein the bonding channel has a depth that varies along a length of the bonding channel from a first depth at an entry to a second depth that is smaller than the first depth.

23. The connector set forth in claim 21 further comprising a plurality of bonding channels disposed in the outside surface of the plastic body.

24. The connector set forth in claim 21, wherein the perimeter of the body is less than or equal to 30 mm.

* * * * *